US005750480A

United States Patent [19]

Xiong et al.

[11] Patent Number: 5,750,480

[45] Date of Patent: May 12, 1998

[54] ALKYLATED ANISOLE LUBRICANT BASESTOCK

[75] Inventors: Yusheng Xiong, Newtown, Pa.; Margaret M. Wu; L. Brewster Young, both of Skillman, N.J.; Alice S. Chu, Spotswood, N.J.

[73] Assignee: Mobil Oil Corporation, Fairfax, Va.

[21] Appl. No.: 619,867

[22] Filed: Mar. 18, 1996

[51] Int. Cl.[6] ..... C10M 105/18

[52] U.S. Cl. ..... 508/580

[58] Field of Search ..... 508/580

[56] References Cited

U.S. PATENT DOCUMENTS

| | | | |
|---|---|---|---|
| 3,717,611 | 2/1973 | Baumer et al. | 508/580 |
| 4,463,207 | 7/1984 | Johnson . | |
| 5,144,082 | 9/1992 | Forbus et al. . | |
| 5,171,915 | 12/1992 | Forbus et al. . | |
| 5,202,040 | 4/1993 | Sanderson et al. . | |
| 5,207,940 | 5/1993 | Carpenter et al. | 508/580 |

*Primary Examiner*—Jacqueline V. Howard
*Attorney, Agent, or Firm*—Malcolm D. Keen

[57] ABSTRACT

A process and composition is disclosed for a hydrolytically stable lubricant base oil exhibiting superior antiwear properties, dispersancy, thermal stability and oxidative stability. The base oil comprises a mixture of mono, di and tri alkylated anisole having the following structure:

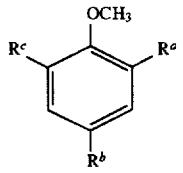

wherein $R^a$, $R^b$ and $R^c$ are hydrogen with at least one of $R^a$, $R^b$ and $R^c$ comprises a secondary alkyl radical containing 8 to 24 carbon atoms.

17 Claims, No Drawings

ALKYLATED ANISOLE LUBRICANT BASESTOCK

FIELD OF THE INVENTION

This invention relates to novel alkylated anisole compositions useful as lubricant basestock and lubricant additives and to their means of preparation. More particularly, the invention relates to novel alkylated anisole lubricant compositions that are hydrolytically stable and exhibit superior wear resistant properties, thermal stability and oxidative stability.

BACKGROUND OF THE INVENTION

Efforts to improve upon the performance of natural mineral oil based lubricants by the synthesis of oligomeric hydrocarbon fluids have been the subject of important research and development in the petroleum industry for at least fifty years and have led to the relatively recent market introduction of a number of superior polyalphaolefin (PAO) synthetic lubricants, primarily based on the oligomerization of alpha-olefins or 1-alkenes. In terms of lubricant property improvement, the thrust of the industrial research effort on synthetic lubricants has been toward fluids exhibiting useful viscosities over a wide range of temperature, i.e., improved viscosity index, while also showing lubricity, thermal and oxidative stability and pour point equal to or better than mineral oil. These new synthetic lubricants lower friction and hence increase mechanical efficiency across the full spectrum of mechanical loads from worm gears to traction drives and do so over a wider range of operating conditions than mineral oil lubricants.

Notwithstanding their generally superior properties, PAO lubricants are often formulated with additives to enhance those properties for specific applications. The more commonly used additives include oxidation inhibitors, rust inhibitors, metal passivators, antiwear agents, extreme pressure additives, pour point depressants, detergent-dispersants, viscosity index (VI) improvers, foam inhibitors and the like. This aspect of the lubricant arts is specifically described in Kirk-Othmer "Encyclopedia of Chemical Technology", 3rd edition, Vol. 14, pp477–526, incorporated herein by reference. Esters such as adipic acid esters and pentaerythritol esters are commonly used additives but such esters are, generally, hydrolytically unstable.

Improvements in lubricant technology pursued by artisans in the field flow from both new additive development addressed to deficiencies in lubricant oligomers and new oligomer development for inherently better properties. Alkylated aromatics, particularly alkylated naphthalene, are known in the prior art as lubricant additives for their antiwear properties, thermal and oxidative stability as disclosed in U.S. Pat. Nos. 4,211,665, 4,238,343, 4,604,491 and 4,714,7944. Antiwear properties of alkylnaphthalene lubricating fluids are presented in Khimiya i Tekhnologiya Topliv i Masel, No. 8, pp. 28–29, August, 1986.

Another important class of additives used in the hydrocarbon lubricant art is polyesters such as esters prepared from pentaerythritol. These esters enhance the solvency and homogeneity of the final lube product, among other utilities. Although they supplement and reinforce lubricant properties esters are vulnerable to hydrolytic instability—a problem which compromises their usefulness as additives. Indeed, the search for hydrolytically stable additives or basestock that can improve upon wear properties, thermal and oxidative stability, dispersancy, lubricity and other critical lubricants functions seems ever present to the lubricant research artisan.

Certain compositions of alkylated anisole in olefin mixture and the hydrogenated product are known in the art as useful lube basestock. U.S. Pat. No. 5,202,040 discloses anisole alkylation with olefin oligomers for the purpose of increasing viscosity of PAO type synthetic lubricant base stocks. The invention is directed toward compositions produced by alkylation of anisole with linear olefins concomitant with the oligomerization of the linear olefins to produce a mixture of olefin oligomers and alkylanisole. Alkylated anisole is the minor component of the mixture. The product mixture is useful as lubricant after hydrotreating to saturate olefin oligomers. However, the hydrotreating step also saturates the anisole ring which has a negative effect on thermal and oxidative stability plus solvency and lubricity of the fluid.

U.S. Pat. No. 5,171,915 teaches a process of alkylating anisole with mixtures of olefin dimers. The olefin dimers employed as alkylating agent are a unique class of branched internal monoolefin dimers and vinylidenyl olefin prepared by dimerization of $C_{10}$+ alpha olefins in contact with reduced chromium oxide catalyst. The product of such process is a complicated mixture and no specific structure of alkylanizole is identified or claimed in that patent.

U.S. Pat. No. 4,463,207 provides an example of anisole alkylation with 1-dodecene under a supported tantalum chloride/oxide catalyst. The product contains 98% of the mono alkylate and is not useful as a lubricant base stock. The patent claims are addressed to a process for benzene and substituted benzene alkylation.

A. A. Durrani and co-workers [J. C. S., Perkin I, 1979, 2079] describes the synthesis of 3- and 4-n-alkylanisoles where the alkyl groups are primary. These compounds were synthesized by reacting 1-alkyllithium with fluoroanisole. They are not useful as lubricants because of high volatility.

The objective of the present invention is to provide a unique lubricant basestock or additive composition that is hydrolytically stable while exhibiting superior thermal and oxidative stability and antiwear properties.

Another objective of the invention is to provide a process to produce the foregoing unique lubricant basestock by aromatics alkylation with olefins without producing a significant amount of olefin oligomers.

SUMMARY OF THE INVENTION

The discovery comprising the instant invention relates to the alkylation of anisole (methoxybenzene) with long chain alpha olefins or internal olefins to form mixtures of alkylanisole useful as lubrication base oil. The alkylation reaction can be carried out with conventional Lewis acid alkylation catalysts, with solid catalysts such as super acid metal oxides, acid clays, zeolites or ion-exchange resin catalyst. The product of the invention unexpectedly exhibits superior antiwear properties as well as improved thermal and oxidative stability over polyalphaolefin (PAO) type lubricants. The novel product of the invention also provides additive solvency and dispersancy functions to lubricant formulations. When compared to ester basestock, the hydrolytically stability of the product of the invention overcomes this important problem of ester-type lubricant additives, without a compromise in performance.

More particularly, the invention comprises a hydrolytically stable lubricant base oil exhibiting superior antiwear properties, dispersancy, thermal stability and oxidative stability. The base oil comprising a mixture of mono, di and trialkylated anisole having the following structure:

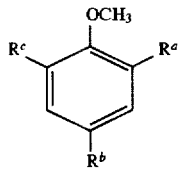

wherein $R^a$, $R^b$ and $R^c$ are hydrogen with at least one of $R^a$, $R^b$ and $R^c$ comprising a secondary alkyl radical containing 8 to 24 carbon atoms. Further, $R^a$, $R^b$ and $R^c$, alike or different, are $CHR^1R^2$ where $R^1$ is methyl and $R^2$ is alkyl containing 6 to 22 carbon atoms. Also, when $R^a$, $R^b$ and $R^c$, alike or different, are $CHR^1R^2$, $R^1$ can be alkyl containing 2 to 21 carbon atoms and $R^2$ can be alkyl containing up to 21 carbon atoms wherein the combination of $R^1$ and $R^2$ contains 7 to 23 carbon atoms.

The lubricant base oil of the invention may further contain lubricant additives taken from the group consisting of dispersants, detergents, viscosity index improvers, extreme pressure/antiwear additives, antioxidants, pour point depressants, emulsifiers, demulsifiers, corrosion inhibitors, antirust inhibitors, antistaining additives, friction modifiers, and the like.

The product of the invention is produced by a process comprising contacting anisole and an olefinic alkylating agent feedstream comprising $C_8$–$C_{24}$ monoolefins in an alkylation zone with acidic alkylation catalyst under alkylation conditions whereby alkylated anisole is produced comprising a mixture of mono, di and trialkylated anisole having the foregoing structure.

DETAILED DESCRIPTION OF THE INVENTION

Anisole (methoxybenzene) can be alkylated with long chain alpha or internal olefins to form mixtures of alkylanisole useful as lubrication base oil. The process of the invention provides a product that has better thermal and oxidative stability than PAO type lubricants. In comparison with ester base oils, alkylated anisole provides additive solvency and dispersancy functions required in modern lubricant formulations. However, the product is superior to esters, especially since it is hydrolytically stable.

The alkylation reaction can be carried out with solid catalysts such as WOx/ZrO2, acid clay, zeolites and ion-exchange resin catalysts. Preferably, the olefin feed is slowly added to a mixture of anisole and catalyst to minimize the formation of olefin oligomers. The viscometric property of the alkylated anisole depends on the length of olefin used and the extent of multiple alkylation. The viscosity can be readily varied from 3 cS to 6 cS, or extended to 10 cS (KV/100° C.).

The alkylated anisole product consists of mono-, di- and tri secondary alkylanisoles. The exact ratio of monoalkylation to dialkylation and trialkylation depends on the olefin to anisole mole ratio used in the alkylation reaction. For the monoalkylanisole fraction produced by the process of the invention, detailed analysis with GC-MASS revealed many side chain isomers such as 2-arylalkane and 3-arylalkene. The positions of alkylation on the anisole ring are at the ortho- and para positions.

The alkylation process of the invention employs alkylation catalyst selected from Lewis acids such as HF, $H_2SO_4$, $AlCl_3$, $BF_3$, $FeCl_3$, $TiCl_4$, $ZnCl_2$ and $P_2O_5$. Also, effective catalyst are selected from acidic layered clays, acidic natural or synthetic zeolites and mixed metal oxide super acids. Mixed metal oxide super acids are described in M. Hino and K. Arata, J. Chem. Soc. Chem. Commun., 1987, 1259; and K. Arata and M. Hino, Proc. 9th Int. Cong. on Catal., 1988, 4, 1727 and U.S. Pat. No. 5,453,556. The entire disclosures of these publications and patent are expressly incorporated herein by reference. Mixed metal oxide super acids, especially $WO_x/ZO_2$, are the preferred catalysts of the invention.

The catalysts described herein as mixed metal oxide super acids comprise an oxide of a Group IVB metal, preferably zirconia or titania. The Group IVB metal oxide is modified with an oxyanion of a Group VIB metal, such as an oxyanion of tungsten, such as tungstate. The modification of the Group IVB metal oxide with the oxyanion of the Group VIB metal imparts acid functionality to the material. The combination of Group IVB metal oxide with an oxyanion of a Group VIB metal is believed to enter into an actual chemical interaction which, in any event, provides a composition with more acidity than a simple mixture of separately formed Group IVB metal oxide mixed with a separately formed Group VIB metal oxide or oxyanion.

Zeolites are also effective alkylation catalysts for the process of the invention. The effective zeolite catalysts include ZSM-5, ZSM-11, ZSM-12, ZSM-23, ZSM-35, and ZSM-48, ZSM-50, Zeolite Beta, MCM-56, MCM-22, MCM-36, MCM-49, ultrastable zeolite Y (USY), zeolite X, TMA Offretite, TEA Mordenite, Clinoptilolite, Mordenite, rare earth-exchanged zeolite Y (REY), Amorphous Silica-Alumina and Dealuminized Y. Catalysts also include mixed metal oxide superacids such as $WO_x/ZrO_2$ and acidified clays.

MCM-56 is also a useful catalyst for the alkylation process of the present invention. MCM-56 is a member of the MCM-22 group useful in the invention which includes MCM-22, MCM-36, MCM-49 and MCM-56. MCM-22 is described in U.S. Pat. No. 4,954,325. MCM-36 is described in U.S. Pat. No. 5,250,277 and MCM-36 (bound) is described in U.S. Pat. No. 5,292,698. MCM-49 is described in U.S. Pat. No. 5,236,575 and MCM-56 is described in U.S. Pat. No. 5,362,697.

Olefins useful as alkylating agents in the present invention include $C_8$–$C_{24}$ alpha olefins or internal olefins, particularly 1-octene, 1-decene and 1-dodecene. Individual olefins may be used as alkylating agent or the alkylating agent may comprise a mixture of $C_8$–$C_{24}$ alpha olefins or internal olefins.

The alkylation of anisole with olefins can be carried out at a temperature between 50° F. and 1,000° F., pressure between atmospheric and 7,000 kPa. Preferably, the alkylation reaction is carried out by slowly adding olefin to a mixture of anisole and alkylation catalyst at a temperature between 50° F. and 500° F. at or near atmospheric pressure. For $WO_x/ZrO_2$, a temperature of 50° F. to 300° F. is preferred. For conventional Friedel Crafts catalyst, zeolites or acid clay type catalysts a temperature between 50° F. and 650° F. can be employed. Under these conditions a preponderance of the alkylation product comprises dialkylated anisole wherein the alkyl substituents groups are secondary alkyl groups.

The following Examples 1–9 illustrate the practice of the process of the invention and the properties and utility of the alkylated anisole produced by the process.

EXAMPLE 1

This example illustrates the use of Wox/Zr2 catalyst for anisole alkylation. To a 2000-ml flask charged with anisole (216 g, 2.00 mole) and Wox/ZrO2 catalyst (32 g, 3.2%) at 40° C. was added 1-dodecene (758 g, 4.50 mole) over a 2 hour period. The reaction temperature quickly rose to 95° C. and was maintained between 95°–100° C. by heating or cooling as needed. Heating was continued for 2 more hours after the addition was finished. After removal of spent catalyst the crude product was distilled to remove any unconverted olefins to give a 94% yield of colorless oil.

GC chromatographic analysis was carried out on the product of Example 1. The detailed GC analysis on the mono-alkylated anisole is shown in Table 1. Higher boiling di- and tri-alkylated anisole have too complicated isomer distribution and are not easy to resolve in GC. Their structure is based on comparative analysis from the mono-alkylated anisole and NMR spectra of the whole mixture. An infra-red (IR) spectra of the alkylated anisole mixture was also prepared. The absence of any OH absorption in IR spectra indicates that there is no phenol derivative formed during the alkylation reaction.

The viscometric properties and composition of the product of Examples 1–8 are shown in Table 2.

specified reaction temperature the catalyst was removed by filtration and the unconverted olefin was removed by distillation. The results are also included in Table 2.

EXAMPLE 9

Example 9 presents the results of tests carried out to determine the thermal and oxidative stability of alkylated anisole versus polyalphaolefin (PAO) and adipic ester lubricant base stocks. The results are presented in Table 3. The thermal stability test was carried out under nitrogen for specified time and temperature. The test sample (10 g in glass flasks) was degassed before testing. Data in the 2nd and 3rd columns of Table 3 clearly shows that alkylated anisole has higher thermal stability than adipic ester and pentaerithritol esters or polyol esters. B-10 test in an in-house test method for evaluating oxidative stability of lubricants and RBOT is an ASTM standard method (D2272). These data demonstrated that alkylated anisole has better oxidative stability than PAO and is comparable to that of esters.

EXAMPLE 10

This example demonstrates that a homogeneous catalyst such as $BF_3$ can be used to catalyze alkyl anisole synthesis.

TABLE 1

Isomer distribution of mono-AA fraction of Example 1

| Isomer | p-2 | p-3 | p-4 | p-5 | p-6 | o-2 | o-3 | o-4 | o-5 | o-6 |
|---|---|---|---|---|---|---|---|---|---|---|
| R1 | $CH_3$ | $C_2H_5$ | $C_3H_7$ | $C_4H_9$ | $C_5H_{11}$ | $CH_3$ | $C_2H_5$ | $C_3H_7$ | $C_4H_9$ | $C_5H_{11}$ |
| R2 | $C_{10}H_{21}$ | $C_9H_{19}$ | $C_8H_{17}$ | $C_7H_{15}$ | $C_6H_{13}$ | $C_{10}H_{21}$ | $C_9H_{19}$ | $C_8H_{17}$ | $C_7H_{15}$ | $C_6H_{13}$ |
| % | 35.3 | 16.9 | 6.9 | 4.7 | 3.6 | 11.3 | 12.2 | 3.9 | 3.3 | 2.1 |

TABLE 2

Examples 1–8 of Anisole Alkylation

| | Ex. 1 | Ex. 2 | Ex. 3 | Ex. 4 | Ex. 5 | Ex. 6 | Ex. 7 | Ex. 8 |
|---|---|---|---|---|---|---|---|---|
| Olefin/anisole mole ratio | 2.25 ($C_{12}^{=}$) | 2.0 ($C_{14}^{=}$) | 2.4 ($C_{12}^{=}$) | 2.5 ($C_{12}^{=}$) | 2.5 ($C_{12}^{=}$) | 2.0 ($C_{14}^{=}$) | 1.0 ($C_{16}^{=}$) | 2.0 ($C_{16}^{=}$) |
| Catalyst | WO/$ZrO_2$ 3.2% | WO/$ZrO_2$ 2.4% | WO/$ZrO_2$ 3.0% | Acid clay 10% | Amberlyst 8.6% | USY 10% | USY 5% | MCM-22 2.5% |
| Temp. °C. | 95–100 | 95 | 95–100 | 150 | 150 | 180 | 150 | 150 |
| Reaction Time, hr | 4 | 15 | 8 | 5.5 | 7 | 6 | 48 | 7 |
| Conversion | >94% | 94% | >95 | 96 | 94 | 82 | 46 | 74 |
| Composition (GC) mono-alkylated, % | 5.5 | 7.0 | 1.6 | | 5.8 | 44.1 | 100 | |
| olefin dimer, % | 0.3 | 0.9 | 1.0 | | 6.2 | 5.8 | | |
| di-alkylated | 58.2 | 71.5 | 57.3 | 42 | 60.2 | 49.5 | | |
| tri-alkylated | 36.0 | 20.6 | 40.1 | 58 | 27.8 | 0.6 | | |
| Viscosity | | | | | | | | |
| @100C, cS | 5.36 | 5.77 | 5.66 | 6.3 | 4.66 | 3.66 | 3.17 | 5.29 |
| @40C, cS | 31.22 | 32.93 | 33.76 | 39.6 | 26.08 | 17.49 | 13.84 | 28.31 |
| VI | 105 | 117 | 106 | 108 | 92 | 31 | 84.5 | 120.6 |
| Pour Point, °C. | −42 | −17 | −40 | <−40 | <−43 | −42 | | |
| Bromine No. (D1159) | NA | NA | NA | 2.68 | 10.13 | NA | NA | NA |

EXAMPLES 2–6

Examples 2–6 were carried out similarly to that of Example 1 except that different catalysts or different temperatures were used. The conditions and results are shown in Table 2.

EXAMPLES 7–8

Example 7–8 were run with all starting materials charged into the reactor at the beginning. After certain periods at the In this example, 200 grams of anisole (2 moles) was charged into a three liter reaction flask. 1-Decene, 518 grams (4 moles) containing 7.2 grams of propanol was charged into a feed flask. $BF_3$ gas was bubbled through the reaction flask and the feed flask. The 1-decene solution was pumped into the reaction flask in 4 hours. When an exotherm occurred the reaction flask was cooled with brine water to room temperature. After six hours of reaction time the reaction was discontinued by purging with $N_2$ followed by quenching with NaOH. The organic layer was separated and distilled to remove any unreacted starting material. The residual oil has the following properties: KV @ 100° C.=5.05 cS. KV @ 40° C.=30.9 cS. viscosity index (VI)=84. The oil had excellent thermal and oxidative stability.

EXAMPLE 11

This example was carried out similarly to that of Example 10 except that 108 grams of anisole. 224 grams of 1-hexadecene and 5 grams of propanol were used at the start of the reaction. The product had the following properties: KV @ 100° C.=5.78 cS. KV @ 40° C.=33.4 cS. VI=115. The oil had excellent thermal and oxidative stability.

EXAMPLE 12

This example was carried out similarly to that of Example 11. The olefin use was a mixture of 1-hexadecene and 1-octadecene. The product had the following properties: KV @ 100° C.=9.20 cS. KV @ 40° C.=62.5 cS. VI=125. The oil had excellent thermal and oxidative stability.

The novel alkylated anisole lubricant base stock can be easily synthesized with a variety of catalysts and demonstrates better thermal and oxidative stability than PAO and adipic ester. Because alkylated anisole is hydrolytically stable. this discovery represents a significant improvement over ester base stock.

TABLE 3

Thermal and Oxidative Stability of Alkylated Anisole (AA) Compared with Esters and PAO

| | Thermal Stabil. 274° C. 72 hr | Thermal Stabil. 302° C. 72 hr | Thermal Stabil. 310° C. 72 hr | B-10 (M334) 260° F. 40 hr | B-10 (M334-9) 315° F. 40 hr | B-10 (M334-10) 375° F. 24 hr | ROBT min |
|---|---|---|---|---|---|---|---|
| AA | | | | | | 287% | 65 |
| Δwt: | | | −5% | | | | |
| ΔKv/100° C. | | | −11% | | | | |
| ΔKv/40° C. | | | −17% | | | | |
| AA/C12= | | | | | | | |
| Δwt: | | −4.9% | −6.2% | | | | |
| ΔKv/100° C. | | 0.6% | −7.5% | 35% | 172% | | 55 |
| ΔKv/40° C. | | 1.5% | −12% | | | | |
| AA/C12= | | | | | | | |
| Δwt: | | −2.3% | −6.6% | | | | |
| ΔKv/100° C. | | −2.3% | 2.8% | | | | |
| ΔKv/40° C. | | −9.7% | −6.5% | | | | |
| Adipic Ester | | | | | | | |
| Δwt: | −11.2% | | | | | | |
| ΔKv/40° C. | −27% | | | | | | 75 |
| TMP ester | | | | | | | |
| Δwt: | | −2.7% | | | | | |
| ΔKv/40° C. | | −12% | | | | | |
| PE ester | | | | | 139% | | 482 |
| PAO-5 | | | | | | | |
| Δwt: | | −1.8% | | | | | |
| ΔKv/40° C. | | −19% | | 82.4 | | | 25 |

What is claimed is:

1. A hydrolytically stable lubricant base oil exhibiting superior antiwear properties. dispersancy. thermal stability. low pour point and oxidative stability. said base oil consisting essentially of a mixture of mono. di and tri alkylated anisole having the following structure:

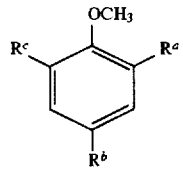

wherein $R_a$. $R_b$ and $R_c$ are hydrogen with at least one of said $R_a$. $R_b$ and $R_c$ comprising a secondary alkyl radical containing 8 to 24 carbon atoms. produced by contacting anisole and an olefinic alkylating agent feedstream comprising $C_8$–$C_{24}$ monoolefins in an alkylation zone with acidic alkylation catalyst under alkylation conditions which minimize the formation of olefin oligomers whereby a lubricant consisting esentially of alkylated anisole free of olefin oligomers is produced and separating and recovering said alkylated anisole lubricant having a pour point below −20° C.

2. The base oil of claim 1 wherein $R_a$. $R_b$ and $R_c$. alike or different. are $CHR^1R^2$ where $R^1$ is methyl and $R^2$ is alkyl containing 6 to 22 carbon atoms.

3. The base oil of claim 1 wherein $R_a$. $R_b$ and $R_c$. alike or different. are $CHR^1R^2$ where $R^1$ is alkyl containing 2 to 21 carbon atoms and $R^2$ is alkyl containing up to 21 carbon atoms wherein the combination of $R^1$ and $R^2$ contains 7 to 23 carbon atoms.

4. The mixture of claim 1 wherein dialkylated anisole comprises between 40 and 75 weight percent of the mixture and is essentially free of olefin oligomer.

5. The mixture of claim 4 wherein said dialkylated anisole contains at least 50 weight percent of dialkylated anisole.

6. The mixture of claim 4 comprising mainly dialkylated anisole having a viscosity at 40° C. greater than 30 centistokes, viscosity index above 100 and pour point below −20° C.

7. A hydrolytically stable, wear resistant hydrocarbon lubricant oil mixture comprising polyalphaolefins oligomers and the base oil of claim 1.

8. The mixture of claim 7 wherein the polyalphaolefin oligomer comprises the oligmerization product of 1-decene.

9. The mixture of claim 7 containing at least about 20 weight percent of the base oil of claim 1 wherein said mixture exhibits a superior wear resistance pursuant to the Four Ball Wear Test D4217.

10. A process for the preparation of alkylanisole suitable as liquid lubricant basestock or additive exhibiting superior antiwear properties, dispersancy, thermal stability, low pour point and oxidative stability comprising:

contacting anisole and an olefinic alkylating agent feedstream comprising $C_8$–$C_{24}$ monoolefins in an alkylation zone with acidic alkylation catalyst under alkylation conditions which minimize the formation of olefin oligomers whereby a lubricant consisting essentially of alkylated anisole is produced comprising a mixture of mono, di and tri alkylated anisole having the following structure:

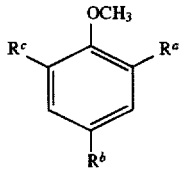

wherein $R^a$, $R^b$ and $R^c$ are hydrogen with at least one of said $R^a$, $R^b$ and $R^c$ comprising a secondary alkyl radical containing 8 to 24 carbon atoms; and separating and recovering said alkylated anisole lubricant having a pour point below −20° C.

11. The process of claim 10 wherein said olefins comprise alpha olefins or internal olefins.

12. The process of claim 10 wherein said alkylating conditions comprise temperature between −30° and 350° C., pressure between 700 and 7000 kPa, wherein said alkylating agent is slowly added to said anisole whereby the formation of olefin oligomers is essentially eliminated.

13. The process of claim 10 wherein said acidic alkylation catalyst comprises Lewis acid.

14. The process of claim 13 wherein said Lewis acid is taken from the group consisting essentially of $BF_3$, $AlCl_3$, HCl, HF, HBr, $H_2SO_4$, $H_3PO_4$, $P_2O_5$, $SO_3$, $SnCl_4$, $FeCl_3$, $ZnCl_2$, $TiCl_4$, $SbCl_5$, acidic zeolites such as H—ZSM—5, zeolite Y, amorphous aluminosilicates and organic acids such as R—$SO_3H$ where R is a polymeric resin such as sulfonated polystyrene.

15. The process of claim 13 wherein said Lewis acid comprises solid metal oxide super acids.

16. The process of claim 15 wherein said super acid comprises $WO_x/ZrO_2$.

17. The lubricant base oil of claim 1 further comprising lubricant additives taken from the group consisting of dispersants, detergents, viscosity index improvers, extreme pressure/antiwear additives, antioxidants, pour depressants, emulsifiers, demulsifiers, corrosion inhibitors, antirust inhibitors, antistaining additives, friction modifiers.

* * * * *